US005745037A

United States Patent [19]

Guthrie et al.

[11] Patent Number: 5,745,037

[45] Date of Patent: Apr. 28, 1998

[54] PERSONNEL MONITORING TAG

[75] Inventors: Warren E. Guthrie, Glen Ellyn; Daniel D. Cox, Palatine, both of Ill.

[73] Assignee: Northrop Grumman Corporation, Los Angeles, Calif.

[21] Appl. No.: 663,340

[22] Filed: Jun. 13, 1996

[51] Int. Cl.[6] ..... G08B 23/00

[52] U.S. Cl. ..... 340/573; 340/539; 340/825.14

[58] Field of Search ..... 340/573, 574, 340/539, 825.72, 825.14, 825.08, 825.2; 455/83

[56] References Cited

U.S. PATENT DOCUMENTS

| | | | |
|---|---|---|---|
| 3,163,856 | 12/1964 | Kirby | 340/571 |
| 4,593,273 | 6/1986 | Narcisse | 340/539 |
| 4,611,198 | 9/1986 | Levinson et al. | 340/539 |
| 4,675,656 | 6/1987 | Narcisse | 340/539 |
| 4,710,751 | 12/1987 | Webster | 340/522 |
| 4,747,120 | 5/1988 | Foley | 379/38 |
| 4,814,751 | 3/1989 | Hawkins et al. | 340/573 |
| 4,853,692 | 8/1989 | Wolk et al. | 340/573 |
| 4,885,571 | 12/1989 | Pauley et al. | 340/573 |
| 4,899,135 | 2/1990 | Ghahariiran | 340/573 |
| 4,918,432 | 4/1990 | Pauley | 340/573 |
| 4,952,913 | 8/1990 | Pauley et al. | 340/573 |
| 4,952,928 | 8/1990 | Carroll et al. | 340/825.54 |
| 4,998,095 | 3/1991 | Shields | 340/574 |
| 5,014,040 | 5/1991 | Weaver et al. | 340/572 |
| 5,021,794 | 6/1991 | Lawrence | 340/573 X |
| 5,032,823 | 7/1991 | Bower et al. | 340/568 |
| 5,047,750 | 9/1991 | Hector | 340/573 |
| 5,075,670 | 12/1991 | Bower et al. | 340/573 |
| 5,079,541 | 1/1992 | Moody | 340/573 |
| 5,115,223 | 5/1992 | Moody | 340/573 |
| 5,115,224 | 5/1992 | Kostusiak et al. | 340/574 |
| 5,182,543 | 1/1993 | Siegel et al. | 340/531 |
| 5,189,395 | 2/1993 | Mitchell | 340/539 |
| 5,204,670 | 4/1993 | Stinton | 340/825.54 |
| 5,218,344 | 6/1993 | Ricketts | 340/573 |
| 5,289,163 | 2/1994 | Perez et al. | 340/539 |
| 5,416,468 | 5/1995 | Baumann | 340/573 |
| 5,440,295 | 8/1995 | Ciecwisz et al. | 340/573 |
| 5,448,221 | 9/1995 | Weller | 340/539 |
| 5,576,689 | 11/1996 | Queen | 340/514 |
| 5,589,821 | 12/1996 | Sallen et al. | 340/573 |
| 5,617,074 | 4/1997 | White | 340/573 |

*Primary Examiner*—Jeffery Hofsass
*Assistant Examiner*—Anh La
*Attorney, Agent, or Firm*—Terry J. Anderson; Karl J. Hoch, Jr.

[57] ABSTRACT

A method for accounting for individual persons of a plurality of persons based upon random times that occur as a function of a first specified time interval, and a random interval monitoring system that operates in accordance with the method to report information regarding the presence of both desired and undesired conditions affecting a person. The method includes a first step of transmitting information signals based upon random times from individual ones of a plurality of tags each to be worn by respective persons to at least one of at least one master transceiver and at least one transceiver. The information signals transmitted from each tag correspond to whether a tag is being worn and to certain activities or a lack thereof of sensors in electrical communication with the tag including pressure and motion sensing equivocated to actually wearing the tag.

27 Claims, 8 Drawing Sheets

PERSONNEL MONITORING TAG

FIELD OF THE INVENTION

This invention relates generally to monitoring systems and to telemetering. In particular, this invention relates to a system that accounts for persons based upon signals transmitted at random time intervals from transmitters worn by the persons.

BACKGROUND OF THE INVENTION

It is known in the art to provide an identification system using transponders communicating with an identification receiver. For example, U.S. Pat. No. 5,491,468, issued to Everett et al., discloses a portable tag which receives energy from a reading device via magnetic coupling for charging a storage capacitor. A discharge of the capacitor powers a coded information transmission circuit during a small percentage of the duty cycle. Transmissions are made from the portable tag to the reading device.

It is also known in the art to provide an identification system using transponders communicating with an identification receiver to reduce the probability that more than one transponder simultaneously transmits to the receiver at a same frequency. U.S. Pat. No. 5,302,954, issued to Brooks et al., and U.S. Pat. No. 5,153,583, issued to Murdoch, disclose a base station for applying a magnetic field to a plurality of transponders. Each of the transponders extracts energy from the magnetic field. The energy extracted by individual ones of the transponders enables the individual transponders to transmit identification codes and/or specially stored or other information to be identified by a base station receiver. The transponders can generate one or more carrier frequencies from an available set of carrier frequencies. As such, many transponders simultaneously transmitting to the base station may be identified under conditions where co-interference would normally preclude correct identification. An idle state, during which individual ones of the transponders do not transmit signals, is employed to reduce the probability that more than one transponder will transmit signals at the same frequency, thereby ensuring that correct identification of a transmitting transponder is made. Signals which may have been corrupted or co-interfered with can be ignored by the receiver. Each transponder can sequentially transmit an identifying code on a randomly selected frequency that is selected from an available set of carrier frequencies.

The use of an idle state and randomly selected frequencies may reduce the probability that more than one transponder will transmit signals of a same frequency at a same time. However, the degree of reduction attainable by these techniques is still limited because, for example, there are typically a restricted number of frequency bands available owing to finite receiver and/or transmitter bandwidths.

There are many occasions where the location and status of persons at particular sites must or should be monitored. One example of such a site is a workplace where supervisory monitoring now occurs where personnel are working with static-sensitive electronic components. Because of the nature of this work, employees must be electrically grounded, commonly through use of a static wrist strap, and supervisors are required to check that each employee properly complies with this necessity. Another example of a site where monitoring must occur is a hospital nursery where, in many instances, armed guards must patrol to guard against infant kidnapping. Thus, while watchful scrutiny can be highly important, it is apparent that personal observation and patrol for these tasks can be quite costly and may not be completely foolproof should personnel responsible for performing these duties be otherwise occupied.

OBJECTS OF THE INVENTION

It is a first object of this invention to provide a method and apparatus for increasing a probability that individual ones of a plurality of transponders will successfully transmit signals to a receiver.

It is a second object of this invention to provide a method and apparatus for accounting for individual persons of a plurality of persons, based upon random times that occur as a function of a specified time interval.

It is a third object of this invention to provide a method and apparatus for sensing an occurrence of a specified event occurring to or initiated by any one of a plurality of persons, and in response thereto, reporting the detection of the occurrence of the specified event to a user.

It is a fourth object of this invention to provide at lease one transmitter tag that initiates communication with at least one of a master transceiver in order to provide monitoring of at least one person.

It is a fifth object of this invention to provide a monitoring system wherein a signal generating device attached to a wearer is monitored to make certain that the device is actually be worn.

It is a sixth object of this invention is to provide a monitoring system wherein a signal generating device can confirm that a wearer whose workplace requires electrical grounding is properly grounded.

Further objects and advantages of this invention will become apparent from a consideration of the drawings and ensuing description.

SUMMARY OF THE INVENTION

The foregoing and other problems are overcome and the objects of the invention are realized by a method for accounting for individual persons of a plurality of persons based upon random times, and by a random interval monitoring transceiver system that operates in accordance with the method. The method includes a first step of transmitting information signals at random times from a plurality of individual transmitters (hereinafter also referred to as "tags") each to be worn by a respective person to at least one transceiver. The random times occur as a function of a specified first time interval. The first specified time interval may be programmed by, for example, a user operating a user interface to enter information into a controller of one of the transmitters for specifying an average time interval (i.e., the first time interval). As such, the programmed transmitter transmits information signals at the random times, chronologically occurring ones of which are temporally spaced by intervals having varying durations that are a function of the first specified time interval. In this manner, a general average frequency (e.g., every 5 minutes) with which a routine monitoring of a person is performed can be specified.

Individual transmitters are to be worn by respective individual persons to be monitored. The information signals transmitted from the individual transmitters correspond to whether the tag is in use and therefore being worn. By example, an information signal corresponding to one person represents information identifying that person.

Each at least one transceiver receives information signals from at least one of the plurality of transmitters. In accordance with one embodiment of the invention, in response to receiving an information signal at each at least one transceiver, a next step includes relaying the signal from the transceiver to at least one master transceiver. The master transceiver thereafter provides the signal to an associated security station. The security station has information stored within corresponding to each of the information signals transmitted by the plurality of transmitters, and hence corresponding to each of the persons wearing the transmitters. A next step includes, within the security station, determining that the information signal received from the master transceiver corresponds to at least a portion of the information stored within the security station. Upon such a determination, a next step includes confirming that the person corresponding to the received information signal is accounted for. In this manner, a routine monitoring is performed of each person based upon random times that are a function of the first specified time interval. While performing the monitoring, the system is deemed to be operating in a confidence mode. In accordance with the method of this invention, individual ones of the random times occur randomly during respective individual ones of sequentially occurring predetermined time intervals.

Further in accordance with the method of this invention, the at least one transceiver receives information signals from at least one of the plurality of transmitters depending upon, at least in part, a position of the transceiver relative to that of the at least one of the plurality of transmitters. By example, one transceiver may be located within a same room as a number of the transmitters in order to relay, and thus facilitate, the communication of information signals from the transmitters to a master transceiver. For a case in which at least one of the transmitters is positioned such that it can effectively communicate information signals directly to the master transceiver without a need for relaying the signals to a transceiver, no relaying transceiver is employed. In such a case, the information signals are communicated directly to the master transceiver, which thereafter provides the signals to the associated security station wherein the step of confirming is performed in the manner as described above.

The invention can also operate in a so called "alarm" operating mode, wherein an occurrence or non-occurrence of a specified condition (e.g., movement, lack of movement, an un-worn sensor) affecting any of the persons monitored is detected and ultimately reported to the security station and to a user for verification of the detection. In accordance with the mode of the invention, a sensor coupled to a tag that is worn by an affected person detects an occurrence of the specified event. In response to the detection of the occurrence of the specified event, the tag transmits information signals (alarm signals) to one of the transceivers at random times occurring as a function of a second specified time interval. The second time interval can be specified in a manner that is similar to that described above for the specification of the first time interval. Chronological transmissions of the information signals based upon the second specified time interval are temporally separated as a function of the second time interval, thereby indicating the detection of the specified event occurring to the affected item. Such transmissions during the alarm mode occur, by example, at a rate (e.g., every 10 seconds) that is greater than that of transmissions made by the tag during the confidence (routine monitor) mode. Such an increase in the rate of transmission of information signals is ultimately recognized by the security station. As such, the station, and ultimately a user, are notified of the occurrence of the specified condition affecting the specific person.

In accordance with a preferred embodiment of the monitor, in addition to the random transmissions, each tag also transmits signals using a direct sequence spread spectrum technique.

In another embodiment of the invention, the remote transceivers autonomously perform data reduction by identifying what information needs to be communicated to the master receiver (e.g., what has changed in the monitor or alarm status.). The master transceiver transmits commands to the remote transceivers in order to interrogate them for sending back monitor and alarm status signals. In this manner, information provided from the remote transceivers to the master transceiver relates to changes in monitor or alarm status, as opposed to a complete monitor status.

In accordance with the method of the invention, each individual transmitter transmits information signals independently from other transmitters also being monitored, thereby limiting the probability that the at least one master transceiver will receive more than one information signal simultaneously.

In a further embodiment of the invention, a receive/transmit (RX/TX) tag is provided. The RX/TX tag comprises a transmitter portion and a receiver portion. The RX/TX tag transmits signals at random times occurring as a function of a specified time interval in the same manner as described above. However, the transmitter portion is turned off after a first one of the signals is transmitted, and thereafter the receiver portion is turned on for a predetermined time period. After the predetermined time period has expired, the transmitter portion is turned on again for transmitting a second one of the signals. For this embodiment of the invention, a transceiver which receives the first one of the signals transmitted from the RX/TX tag responds by measuring the frequency of the received signal and by transmitting a response signal to the RX/TX tag on a frequency substantially equal to the measured frequency. The transceiver transmits the response signal in a manner such that the response signal is received by said RX/TX tag within the predetermined time period.

BRIEF DESCRIPTION OF THE DRAWINGS

The above set forth and other features of the invention are made more apparent in the ensuing Detailed Description of the Invention when read in conjunction with the attached drawings, wherein.

DETAILED DESCRIPTION OF THE PREFERRED EMBODIMENT

Figure 1:
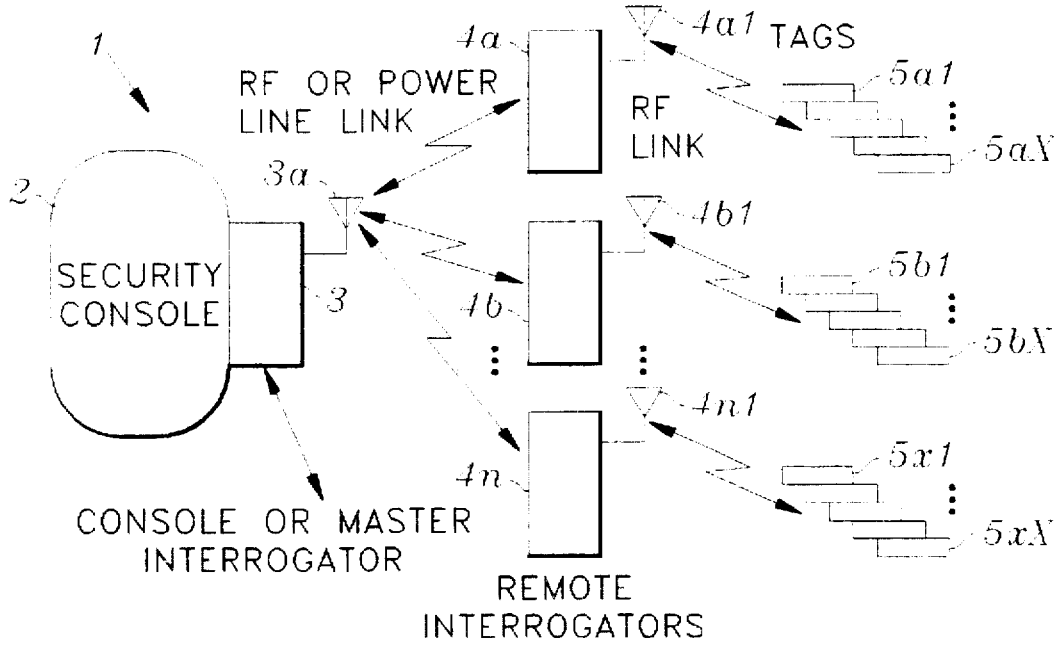
FIG. 1 is a diagram of a random monitor system that is constructed in accordance with this invention.

FIG. 1 illustrates one embodiment of a random interval monitor system 1 (hereinafter also referred to as "RIMS") that is constructed in accordance with this invention. The system 1 comprises at least one console (hereinafter also referred to as a "master transceiver") 3 and a plurality of transmitters (hereinafter also referred to as "tags", "transmit-only tags", or "TXs") 5*a*1–5*xx*. In accordance with the embodiment of the invention illustrated in FIG. 1, the RIMS 1 also comprises at least one remote transceiver (hereinafter also referred to as a "transceiver") 4*a*–4*n*, and at least one security station (confirmation device), which is, by example, a security console 2. In certain other embodiments of the invention, which will be described below, the at least one remote transceiver 4*a*–4*n* is not utilized, and the security console 2 is replaced with another suitable device. These components may thus be considered as optional.

For the purposes of clarity, the ensuing description is made in a context wherein a plurality of transceivers, one security console 2, and one master transceiver 3 are being employed, as is illustrated in FIG. 1. The master transceiver 3 is associated with the security console 2, and can be, by example, mounted thereon. The security console 2 stores monitor information corresponding to each of the plurality of tags 5*a*1–5*xx*, as will be described below. The master transceiver 3 has an antenna 3*a*; each of the remote transceivers 4*a*–4*n* has an antenna 4*a*1–4*n*1, respectively; and, referring to FIG. 1, each tag 5*a*1–5*xx* has a respective antenna 22.

Figure 15:
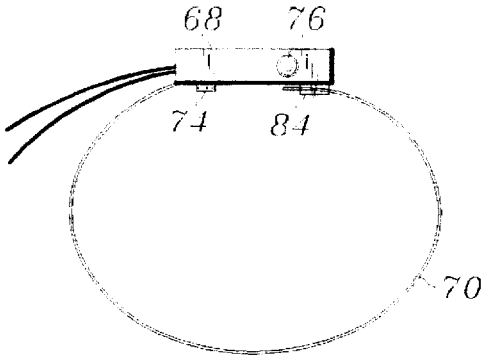
FIG. 15 is an elevation view of a second embodiment of a wearable transmitter device attachable to a wearer with a wrist strap.
Figure 16:
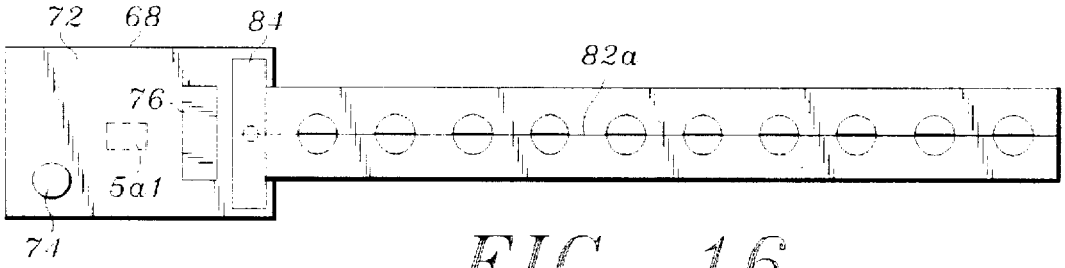
FIG. 16 is a bottom plan view of the wearable transmitter device with a wrist strap of FIG. 15.
Figure 17:
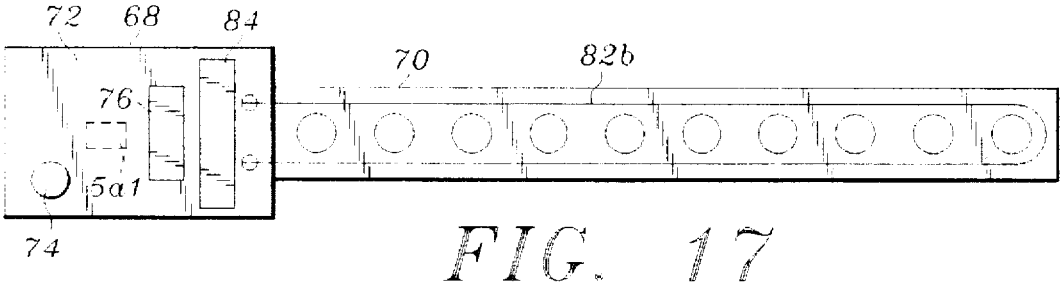
FIG. 17 is a bottom plan view of an alternative embodiment of the wearable transmitter device with a wrist strap of FIG. 15.

It should be noted that although the ensuing description discusses the RIMS 1 in the context of an application for detecting that a transmitter is being worn and, additionally, optionally, that a wearer at a work station is properly grounded and/or for tracking purposes to locate a wearer, it is to be understood that the invention can be employed in other monitoring tasks. Apparatus embodiments of the preferred monitor system are illustrated in FIGS. 13–17. In particular, in FIGS. 13 and 14, a wearable housing 68 having therein a transmitter tag 5*a*1 is attached to a wrist strap 70 and has protruding from its underside 72 a conventional pressure switch 74 which is depressed by contact with the wrist of a wearer. Within the housing 68 is a motion detector 76, generally termed a "motion/bump detector" and available from Fifth Dimension, Trenton, N.J., under catalog numbers 21680-701 or 21725-701. A ground connector comprising two wires 78, 80 leads from a ground connection sensor within the housing 68 for connection to a conventional ground site (not shown). In like manner in a second related embodiment, as illustrated in FIGS. 15–17, a housing 68 attached to a wrist strap 70 has protruding from its underside 72 a conventional pressure switch 74 which is depressed by contact with the wrist of a wearer. Within the housing 68 is the motion detector 76 as described above. Embedded in the strap 70 is an elongate conductive wire 82*a* that becomes a continuous circuit when the strap 70 is wrapped around a wrist and secured by a conductive standard clamp 84 for the embodiment shown in FIGS. 15 and 16, or that is a continuous circuit as a looped wire 82*b* as shown in FIG. 17. Each sensor is in electrical communication with the transmitter tag 5*a*1 inside the housing 68.

Figure 13:
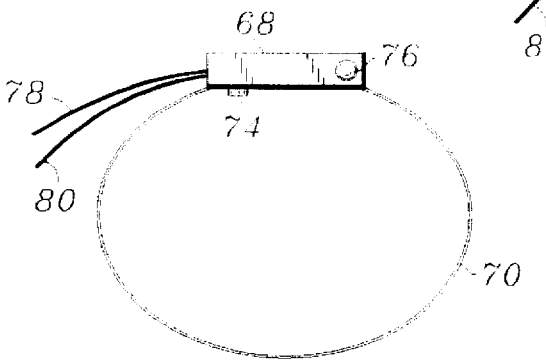
FIG. 13 is an elevation view of a first embodiment of a wearable transmitter device attachable to a wearer with a wrist strap.
Figure 14:
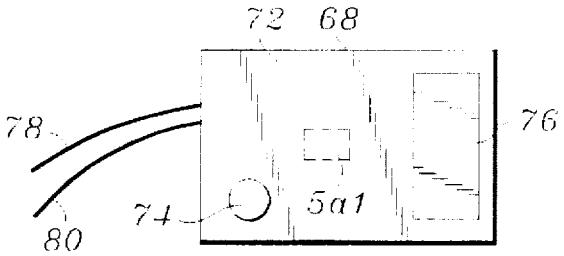
FIG. 14 is a bottom plan view of the wearable transmitter device of FIG. 13.

Operationally, the devices of both embodiments monitor the presence or absence of pressure on the pressure switch 74, which is indicative of whether the tag is being worn, as well as the presence or absence of movement of the motion detector 76. If there is no pressure, or if there is no motion in a specified time interval, the tag 5*a*1 within the housing 68 will respond as described below. In the embodiment of FIG. 13, ground connection confirmation is accomplished by monitoring through the sensor of the presence of a small current sent through a resistor (e.g. 1 MΩ) in the path to ground of the wire leads 78, 80. In the embodiments of FIGS. 15 and 17, current flow through the wire 82*a* or 82*b* likewise is monitored and communicated to the tag.

With respect to the embodiment of FIG. 13, the monitoring system will monitor whether the tag is being worn and whether the housing 68 is connected to a ground site. The ground connection confirmation signal reaches the ground connection sensor for ultimate transfer as described above. Both the pressure sensor 74 and the motion detector 76 determine if the device is being worn since the pressure sensor 74 detects pressure from the body surface and the motion detector 76 detects movement of the body area of the wearer. If there is no pressure, if there is no motion in a specified time interval, and/or if there is no evidence of ground connection, this information is dispatched by the tag as an alarm. While the combination of these two sensors 74, 76 will produce a more reliable indication of whether the device is actually being worn since the information of each sensor is independently sent. Such independent transmissions permit a different weighting of the two sensor measurements and/or setting a different motion-time interval before an alarm status is reached. It is to be understood, however, that only a single sensor can be employed.

With respect to the embodiment of FIGS. 15–17, wherein attachment association is monitored, the wearable device is especially suited for infants as in hospital nurseries. Specifically, the embodiment includes a wrist strap 70 having, in addition to pressure and motion detectors 74, 76, a continuous closed circuit wire 82*a*, 82*b* imbedded within the strap. The strap 70 is tightly placed around the wrist of the infant and therefore is removable only by cutting or otherwise breaking the continuity of the strap. Such an action will also result in breaking the closed circuitry of the wire 82*a*, 82*b* to thereby generate a signal of such a break which is transmitted to the receiver as an alarm status. A plurality of receivers as described above can be strategically located throughout the hospital to thereby track infant movement and safety. Depending upon the transmitter tag's effective transmission range and relative location with respect to the locations of the master transceiver 3 and the remote transceivers 4*a*–4*n*, the tag 5*a*1 is able to communicate effectively with at least one of the master transceiver 3 and one remote transceiver (e.g., remote transceiver 4*a*), as will be described below.

Each of the tags 5*a*1–5*xx* operates in a first operating mode and a second operating mode. The first operating mode, which, for the purposes of this description is also deemed to be a confidence mode, is the operating mode during which regular monitoring is performed and no alarm status is present. While operating in the confidence mode, each individual tag 5*a*1–5*xx* independently communicates RF energy (e.g., confidence signals) over its antenna 22 to one of the remote transceivers (e.g., transceiver 4*a*) at random time intervals (to be described below). In a preferred embodiment of the invention for the transmit-only tags, the tags 5*a*1–5*xx* employ Direct Sequence Spread Spectrum (DSSS), for transmitting signals. The second operating mode is discussed below.

Each of the confidence signals transmitted by an individual tag (e.g., tag 5*a*1) represents bits of information corresponding to the tag 5*a*1, and hence to the particular person wearing the tag 5*a*1. The information includes appropriate pressure and motion, as well as ground connection or strap-wire continuity, depending upon the embodiment involved.

Figure 2:
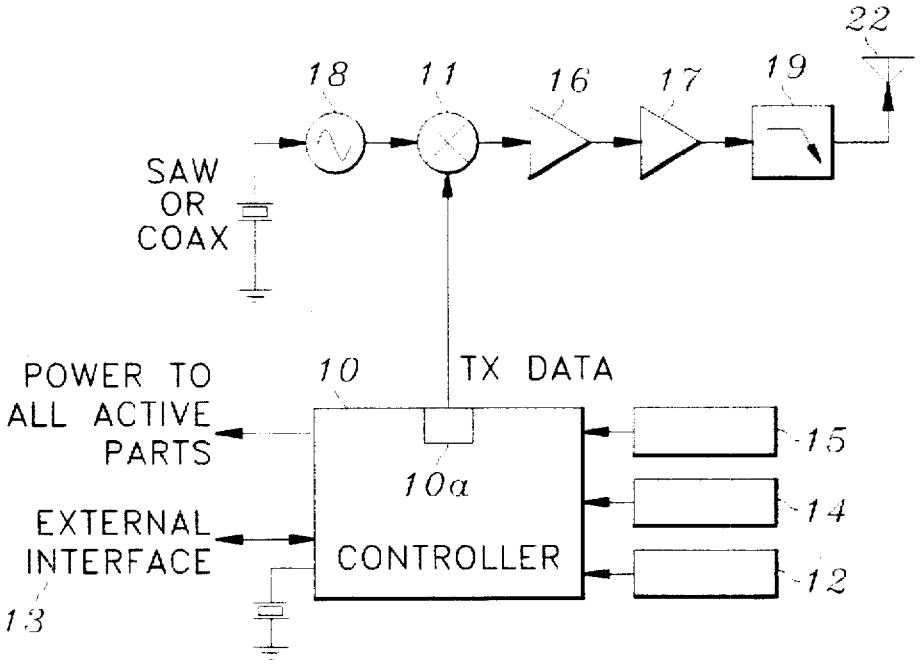
FIG. 2 illustrates a block diagram of a transmit-only tag that is constructed in accordance with one embodiment of the random interval monitor system of FIG. 1.

FIG. 2 illustrates a block diagram of a transmit-only tag (e.g., tag 5*a*1) constructed in accordance with a first and a second embodiment of this invention. A microprocessor controller 10 having a clock 10*a* emits control signals at random times that are determined by the clock 10*a* in a manner that will be described below. Each control signal emitted by the controller 10 is provided to a modulator 15, wherein the signal is mixed with a carrier signal generated by a local oscillator 18. Thereafter, the signal is amplified to an appropriate amplitude by an amplifier 16. The amplifier 17 shown in FIG. 2 is employed in the second (alarm) embodiment of the invention, which will be discussed further below. Amplifier 17 does not necessarily need to be employed in the transmit-only tags of the first embodiment.

Thereafter, the signal is filtered by filter 19, and transmitted as a confidence signal over the antenna 22 to the master transceiver 3 or one of the remote transceivers 4*a*–4*n*. Each tag 5*a*1–5*xx* has an effective transmission range of, by example, at least 200 meters, and has a relatively low effective radiated power (ERP). Also, in a preferred embodiment of the invention, each tag 5*a*1–5*xx* transmits signals on a fixed frequency of, by example, 2.41 GHz.

In accordance with a preferred embodiment of the invention, antenna 22 for the individual tags 5*a*1–5*xx* is small in size and has an ability to radiate energy efficiently in a ground plane and/or in free space. By example, for an operating frequency of 2.41 GHz, the size of the antenna 22 is approximately 1 inch×1 inch, with a thickness of 0.050 inches.

In a preferred embodiment of this invention, the confidence signal is a relatively short duration (e.g., 10 to 100 ms) pulse signal. The generation of such short pulse signals allows each tag 5*a*1–5*xx* to use relatively small amounts of energy over time, and therefore preserves the energy of a power supply, such as a battery (not illustrated).

Figure 4A:
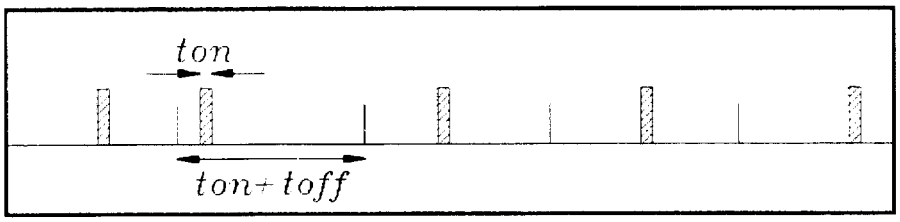
FIG. 4*a* is an illustration of sequentially occurring average time intervals, during each of which occurs a random time slot at which the tag of FIG. 2 transmits a signal.

In a preferred embodiment of the invention, the transmission times are produced truly randomly by employing "external" signals to "seed" a pseudo-random number generator (located within the controller 10) such as, by example, a binary shift register sequence generator, or another means known in the art for producing a pseudo-random sequence. First, in accordance with one of the techniques for generating a pseudo-random sequence, a period (e.g., 5 minutes, or 60 minutes) is specified by, for example, a user entering appropriate initialization data (e.g., a seed) into the controller 10 via the external user interface 13. This period is deemed to be, for the purposes of this description, a first average time intervals. Second, "external" signals are supplied to the controller 10 in response to, by example, detections of events (e.g., pressure, motion, ground connection, closed circuitry) made by at least one sensor (see below for a discussion of sensors 12 and 14. The controller 10 then determines a temporal separation between, for example, two of the "external" signals supplied from the sensor, and uses this determined temporal spacing to "seed" the pseudo-random sequence generator. Based upon the first average time interval and the "seeding" of the pseudo-random number generator via the "external" signals, the controller 10 then emits control signals at random times, individual ones of which occur randomly during respective individual ones of sequentially occurring time intervals having durations equal to the first average time interval. In this manner, the applicable tag (e.g., tag 5*a*1) transmits confidence signals at random times, thereby enabling routine monitor checks (e.g., occurring approximately every 5 minutes, or every 60 minutes) of the person wearing the tag 5*a*1. FIG. 4 illustrates an example of the sequentially occurring time intervals, during each of which occurs a random time slot designated as ton (time-on). For the purposes of this description, the random times associated with the confidence mode are designated as "first random times".

Each remote transceiver 4*a*–4*n* functions as a communication relay to enable effective indirect communication between the master transceiver 3 and at least one tag 5*a*1–5*xx* for cases in which, by example, the master transceiver 3 is not located within the effective transmission range of a tag (e.g., tag 5a1). For example, a remote transceiver (e.g., remote transceiver 4a) is employed to facilitate such communication when a wearer is out of range. For this example, the remote transceiver 4a is positioned with respect to the tag 5a1 and master transceiver 3 in a manner such that it can relay signals from the tag 5a1 to the master transceiver 3. The remote transceiver 4a may be mounted near the entrance of the room where the wearer of the tag 5a1 is located, for example. This remote transceiver 4a may also serve to relay communications from other tags (e.g., tags 5a2–5ax) that are located within the same room, to the master transceiver 3.

In some cases, a single remote transceiver 4a may not be adequate to facilitate communications between the tag 5a1 and the master transceiver 3. In such cases additional remote transceivers 4a–4n may be employed in order to relay the transmissions. It should be noted that this description discusses the invention primarily in the context of an application wherein only a single remote transceiver (e.g., remote transceiver 4a) is employed to facilitate communication between at least one of the tags 5a1–5xx and the master transceiver 3. It also should be noted that, for the case in which a tag (e.g., tag 5a1) is able to communicate directly with a master transceiver 3, no remote transceivers 4a–4n need be employed in order to relay the communications.

Figure 3:
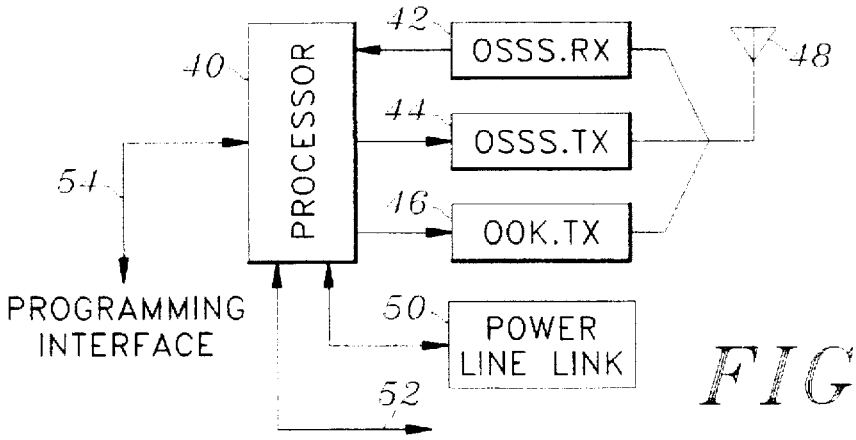
FIG. 3 illustrates a receiver portion of a transceiver that is constructed in accordance with a preferred embodiment of the random interval monitor system of FIG. 1.

In accordance with one alternate embodiment of this invention, the remote transceivers 4a–4n inter-communicate with one another and/or with the master transceiver 3 via AC power lines. FIG. 3 illustrates a power line link 50 for a remote transceiver 4a–4n (or a master transceiver 4).

FIG. 3 illustrates a bock diagram of a transceiver which may function as a master receiver 3 or one of the remote transceivers 4a–4n, and which is constructed in accordance with various embodiments of the invention. An antenna 48 (which forms antenna 3a for a master receiver or antennas 4a1–4nn for the respective remote transceivers), is coupled to a direct Sequence Spread Spectrum Receiver (DSSS RX) block 42, a DSSS transmitter (DSSS TX) block 44, and an "ON-OFF" key transmitter (OOK TX) block 46. The DSSS RX block 42 is employed in all embodiments of the invention for receiving signals from tags 5a1–5nn, other remote transceivers 4a–4n, and the master transceiver 3. The DSSS RX block 42 employs a known type of Direct Sequence Spread Spectrum technique for receiving signals. When a signal is received by the transceiver via antenna 48, the signal is provided to the DSSS RX block 42 wherein it is decoded and checked for errors. Signals that are received with errors from tags 5a1–5xx are ignored. Signals received by a remote transceiver 4a from the master transceiver 3 are error-checked. If the signal is received without error, the remote transceiver 4a responds back to the master receiver 3 with a verification signal. If there is no verification signal received by the master transceiver 3, the master transceiver transmits again, with a random delay determined by the processor 40 of the master transceiver 3, which handles appropriate protocol functions. It should be noted that a situation in which the master transceiver 3 transmits signals to remote transceivers 4a–4n is addressed below with respect to an embodiment of the invention employing data reduction.

The DSSS TX block 44 is employed to transmit, in response to a signal received from the processor 40, signals using a DSSS technique. Signals provided from the DSSS TX block 44 are transmitted via the antenna 48 to other ones of the remote transceivers 4a–4n, or to the master transceiver 3, as is required by the application of interest. The DSSS TX block 44 is primarily employed in the first embodiment of the invention, and in the second embodiment of the invention which will be described below.

The OOK TX block 46 is employed (in lieu of the DSSS TX block 44) in an embodiment of the invention employing receive/transmit(RX/TX) tags, which also will be described below. In the RX/TX embodiment, the OOK TX block 46 is used for transmitting signals to the RX/TX tags.

Depending upon the range being transmitted over, the antenna 48 can be, for example, an omni-directional antenna with low gain, or a high gain, directional antenna (which will increase transmission range approximately 2–3 times) where appropriate. Also, similar to the tags 5a1–5xx, each transceiver has a user-interface 54 for programming information into the transceiver.

In accordance with the embodiment of the invention wherein AC power lines are used to facilitate communications between, by example, remote transceivers 4a4n and/or between a remote transceiver 4a and the master transceiver 3, power line link block 50 is employed instead of the DSSS TX block 44.

Also illustrated in FIG. 3 is an interface line 52 which is used in a master transceiver 3 to interface with the security console 2, or to a pager system.

Having described in detail the operations and construction of the transceiver illustrated in FIG. 3, the operation of the RIMS 1 will now be further discussed. After a signal is received by the master receiver 3, it is forwarded to the security console 2 wherein the signal is recognized as corresponding to a portion of the information stored within the security console 2. More particularly, information stored within the security console 2 corresponds to the bits of information transmitted by each tag 5a1–5xx. As such, when the security console 2 receives a confidence signal from one of the tags (e.g., tag 5a1) of a particular wearer, and thereafter recognizes the received information as corresponding to information stored within the security console 2, it is confirmed that the wearer is properly active.

The second mode in which the tags 5a1–5xx operate is deemed, for the purposes of this description, to be an "alarm mode". This operating mode is useful for tracking the movement of a wearer or for identifying an occurrence of a specified event, such as, for example, improper removal of a tag, a non-grounded condition, etc. The alarm mode is implemented in a manner that is made apparent by the following example. Referring to FIG. 2, motion sensor 12 associated with a tag (e.g., tag 5a1) senses the lack of movement of an arm of a person wearing the tag. The sensor 12 supplies information representing the occurrence of the specified event to the controller 10 which, in response, emits control signals at second random time intervals. The second random time intervals are based upon a second average time interval. The second average time interval is predetermined by, for example, a user entering information into the controller 10 via the user interface 13 for specifying an approximate average frequency (e.g. every 1 second, or every 15 seconds) at which it is desired to be notified of alarm signals once the specified event has been detected. Each control signal is mixed at modulator 15 with a carrier signal generated by local oscillator 18 and amplified by amplifier 16 in the same manner as described above for the confidence mode.

Then, the signal is transmitted as an alarm signal over antenna 22 to one of the remote transceivers (e.g., remote transceiver 4a). Thereafter the alarm signal is relayed to the master transceiver 3, in the same manner as described above for the confidence mode. The master transceiver 3 then supplies the alarm signal to the security console wherein it is determined that, based upon the frequency of reception of the alarm signals with respect to that of the confidence signals, the specified event (e.g., non-movement) has occurred. It should be noted that the second operating mode may also be invoked by the pressure switch monitoring sensor 14 associated with tag 5a1 sensing that a pressure switch is open, or by any other type of sensor interfaced with the tag 5a1 sensing an occurrence of a specified event. for the purposes of this invention, tags 5a1–5xx which are operating in the alarm mode are deemed to be "active tags".

In another embodiment of the invention, the RIMS 1 performs tracking of the wearers. The technique by which the RIMS 1 performs tracking may be any technique known in the art for determining relative locations based upon power measurements of signals received from transmitters located with the respective wearers. The technique can be performed at, for example, the individual remote transceivers 4a–4nm, the master transceiver 3, and/or the security console 2. By example, for a case in which the technique is performed at the security console 2, a first signal received by the security console 2 is measured to determine the received signal's strength. The determined signal strength is stored within the security console 2. Upon a receipt of a following second signal transmitted by the same tags, the security console 2 measures the signal strength of this second signal. Based upon the relative signal strengths of the first and second signals, a displacement of the tag and its associated wearer occurring between the time when the first signal was transmitted and the time when the second signal was transmitted can be determined. A calculation can then be made to determine the location of the wearer. The same process occurs for subsequently received signals. The process can also be carried out by comparing measured signal strengths of signals received from a tag with a reference signal strength transmitted by the tag when at its assigned location.

In another embodiment of the invention, the remote transceivers 4a–4n autonomously perform data reduction by identifying what information needs to be communicated to the master receiver 3 (e.g., what has changed in the monitor or alarm status). This information is provided to the master transceiver 3 in response to a command received from the master transceiver 3 interrogating the remote transceivers 4a–4n to transmit monitor and alarm status signals. In this manner, as opposed to providing a complete list of all current transmitters, the remote transceivers 4a–4n simply provide information indicating, by example, changes in alarm or monitor status. This protocol is applicable in applications using the transmit-only tags and the remote interrogators 4a–4n for facilitating communication (e.g., limited data loading) with the master receiver 3.

In an exemplary situation, a change in status may be identified by the remote transceiver recognizing that a signal has not been received from a particular tag within a first predetermined time period. By example, after a signal is received by remote transceiver 4a from tag 5a1, an internal clock (not illustrated) within the remote transceiver 4a begins to run. If the time kept by the clock then exceeds the first predetermined time value stored within the remote transceiver 4a, a change in status is recognized by the remote transceiver 4a. The change in status may indicate, for example, that a wearer of a tag 5a1 has been moved out of range of the remote transceiver 4a. The remote transceiver 4a stores information which indicates this change in status and which identifies the particular tag (and its wearer) from which the signal was originally transmitted.

it should be noted that these examples are intended to be exemplary in nature and not limiting in scope, and that other changes in status may be identified by a remote transceiver. For example, a remote transceiver can recognize that two signals received from a particular one of the tags have been received by the remote transceiver within a second predetermined time period (i.e., indicating the alarm mode). Also, as described above, the remote transceiver may measure signal strengths of received signals in order to determine whether a wearer has left an assigned or reference location.

As indicated above, the master transceiver 3 transmits commands to the remote transceivers 4a–4n in order to interrogate them for sending back status signals. This may occur at, for example, predetermined time intervals. Once a command signal transmitted by the master transceiver 3 is received by a remote transceiver (e.g., remote transceiver 4a), the remote transceiver 4a responds by transmitting stored information which indicates any changes in status and which identifies particular tags (wearers) associated with those changes in status identified by the remote transceiver 4a since, by example, a last command was received by the master transceiver 3. Thereafter, the information is received by the master transceiver 3 and is then supplied to the security console 2 for notifying, by example, a user of the changes in status affecting the particular tag (wearer) identified by the information. In another embodiment, the remote interrogator 4a responds to commands received from the master transceiver 3 by providing the information indicating changes in status that have been identified and stored by the remote interrogator 4a over a predetermined time period.

Having described several embodiments of the invention, another aspect of the invention will now be discussed which applies to all of the embodiments of the invention, including those discussed below. For this aspect of the invention, the manner in which signals are transmitted from each tag 5a1–5xx can be set to minimize the possibility that signals transmitted by more than one tag 5a1–5xx will be received simultaneously by the master transceiver 3, for example, this may be accomplished by operating the user interface or by using detections made by a sensor (e.g., sensor 12 and/or 14) of each tag 5a1–5xx. Also by example, this may be accomplished by varying the random timing variations (frequencies) of the clock 10a associated with each tag 5a1–5xx. As such, the probability that more than one tag 5a1–5xx will transmit simultaneously receive signals from more than one tag 5a1–5xx, is minimized. This can be further understood in consideration of the following probability equations.

The probability $P_{tx}$ that a particular one of the tags (e.g., tag 5a1) is transmitting at a particular time is represented by the equation:

$$P_{tx} = \frac{ton}{ton + toff}$$

where: Ptx represents the probability that a particular tag (e.g., tag 5a1) is transmitting a signal; ton represents the duration of the transmission of a randomly occurring signal; and toff represents an average time interval between random transmissions.

The probability $P_{ntx}$ that a particular tag will not transmit a confidence signal at a particular time is represented by the equation:

$$P_{ntx} = \frac{toff}{ton + toff}$$

Where: ton and toff represent the same information as defined above.

Based upon the foregoing equations, the probability $P_{tx}$ that one tag (e.g., tag 5a1) transmits a first confidence signal at a time at which no other tags (e.g., tags 5a2–5xx are transmitting confidence signals, and hence the probability that the master transceiver 3a correctly receives the first confidence signal, is represented by the equation:

$$P_{tx} = \left[ 1 - \frac{ton}{ton + toff} \right]^{n}$$

Where: $P_{tx}$ represents the probability that an individual transmitting tag (e.g., tag 5a1) is the only one of the tags 5a1–5xx that is transmitting a signal at a particular time ton and toff have the same meanings as described above; and represents the total number of tags (e.g., tags 5a2–5ax), not including a transmitting tag of interest (e.g., tag 5a1), that may be transmitting a signal at the same time as the transmitting tag 5a1.

Similarly, the probability Pm that a tag (e.g., tag 5a1) transmits at least one of m confidence signals during a time at which no other tags e.g., tags 5a2–5xx) are transmitting confidence signals, and hence the probability that the master transceiver 3a correctly receives at least one confidence signal out of m transmitted confidence signals, is represented by the equation:

$$Pm = 1 - \left[ 1 - \left[ 1 - \frac{ton}{ton + toff} \right]^{n} \right]^{m}$$

Where: n, ton, and toff have the same meanings as described above, and m represents the number of confidence signal transmissions made by a transmitting tag of interest (e.g., tag 5a1).

Figure 5:
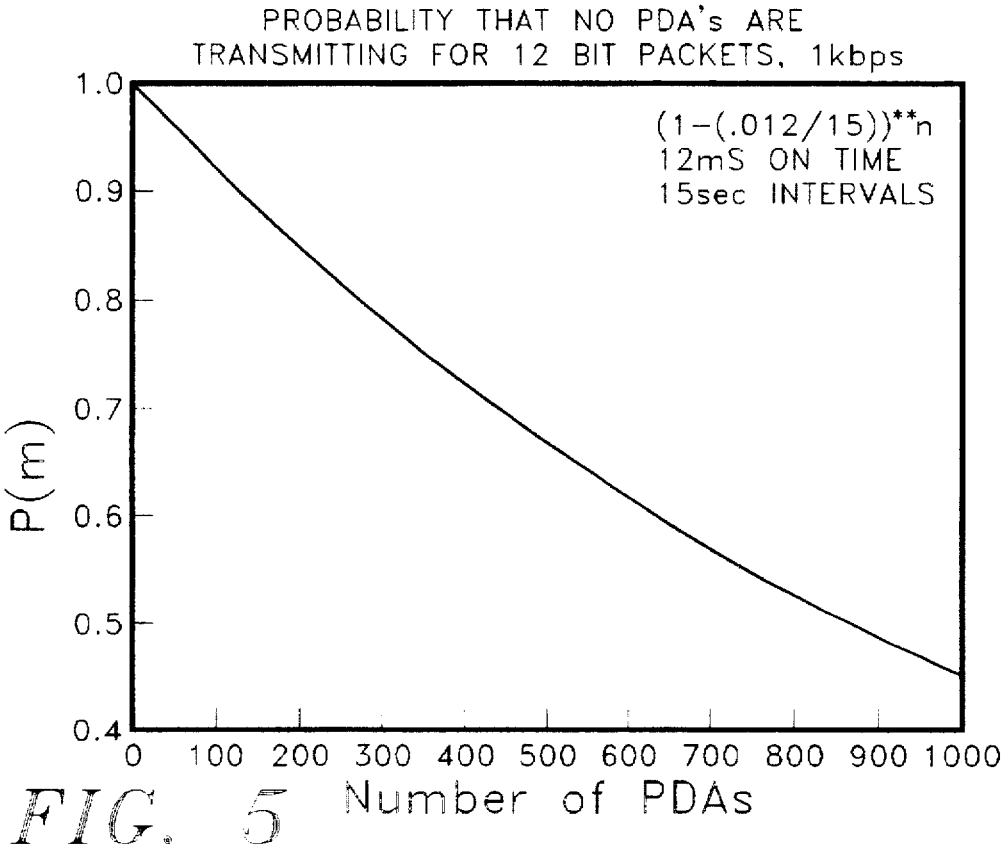
FIG. 5 illustrates a graph representing probabilities that none of a plurality of the tags of FIG. 2 are transmitting alarm signals at any one time, for various numbers of tags randomly transmitting information signals based upon 15 second intervals.

It should be noted that in accordance with these equations, the values of ton, toff and n are relatively smaller during the confidence mode. In light of the above probability analysis, it has been determined that where a substantial number (i.e., more than one thousand) of tags 5a1–5xx are employed in the RIMS 1, the probability that each tag 5a1–5xx will successfully link with the master transceiver 3 at any one time is substantial. FIGS. 5 to 12 illustrate probability graphs for various numbers of tags 5a1–5xx, data bit packets, and data bit rates. FIG. 5 illustrates a graph representing probabilities that no tags 5a1–5xx are transmitting alarm signals at any one time, for a case wherein there are various numbers (0 to 1000) of tags 5a1–5xx randomly transmitting a 12 bit packet, 1 kbps information signals based upon a second average time interval of 15 second duration.

Figure 6:
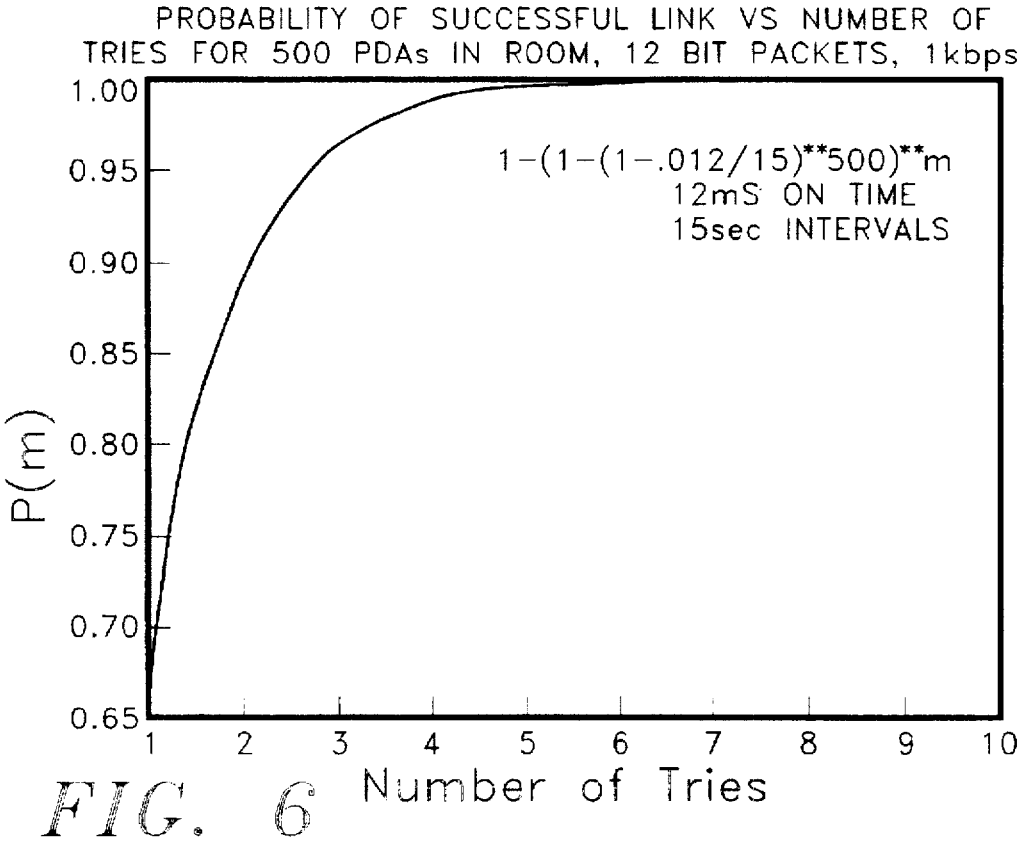
FIG. 6 illustrates a graph representing probabilities that a particular one of 500 of the tags of FIG. 2 will successfully communicate alarm signals with the master transceiver of FIG. 3 per each of a number of random transmissions occurring based upon 15 second intervals.

FIG. 6 illustrates a graph representing probabilities that a particular one tag (e.g., tag 5a1) of 500 tags 5a1–5xx will successfully communicate 12 bit packet, 1 kbps alarm signals with the master transceiver 3 per each of 10 successive random transmissions occurring based upon a second average time interval of 15 second duration.

Figure 7:
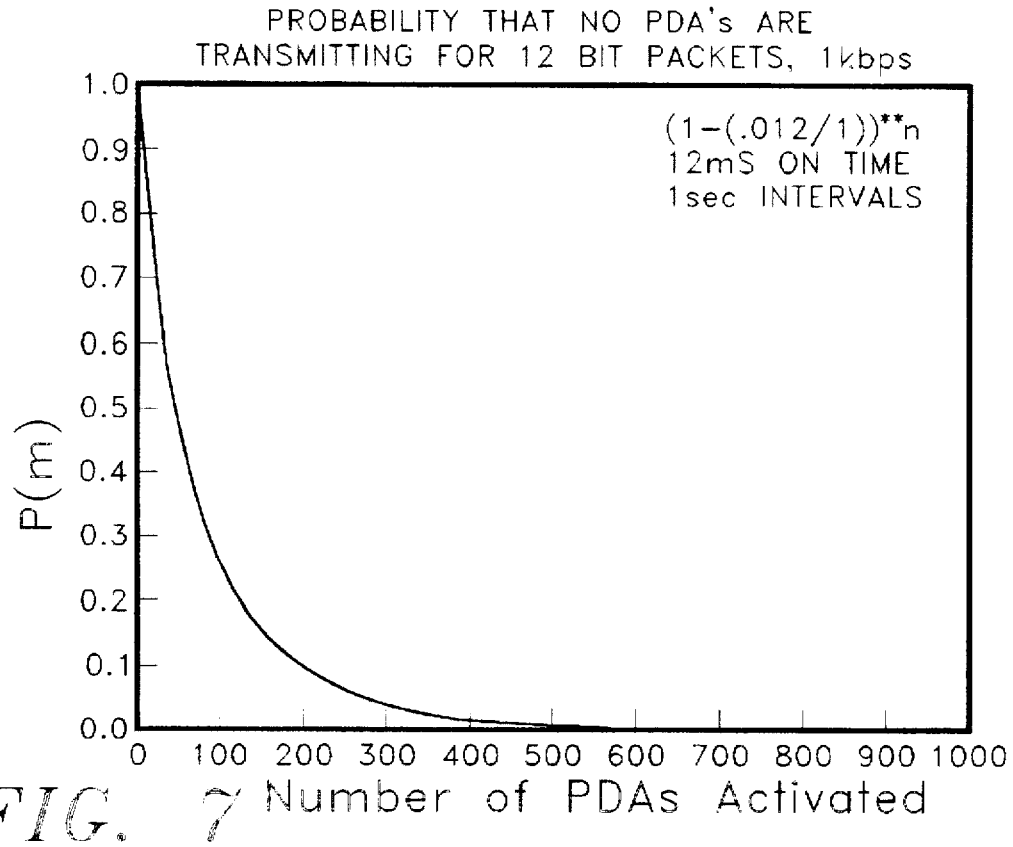
FIG. 7 illustrates a graph representing probabilities that no activated ones of a plurality of the tags of FIG. 2 are transmitting alarm signals at any one time, for various number of tags randomly transmitting information signals based upon 1 second intervals.

FIG. 7 illustrates a graph representing probabilities that no activated ones of various numbers (0 to 1000) of tags 5a1–5xx are transmitting alarm signals at any one time, for a case wherein the tags 5a1–5xx are randomly transmitting 12 bit packet, 1 kbps information signals based upon a second average time interval of 1 second duration.

Figure 8:
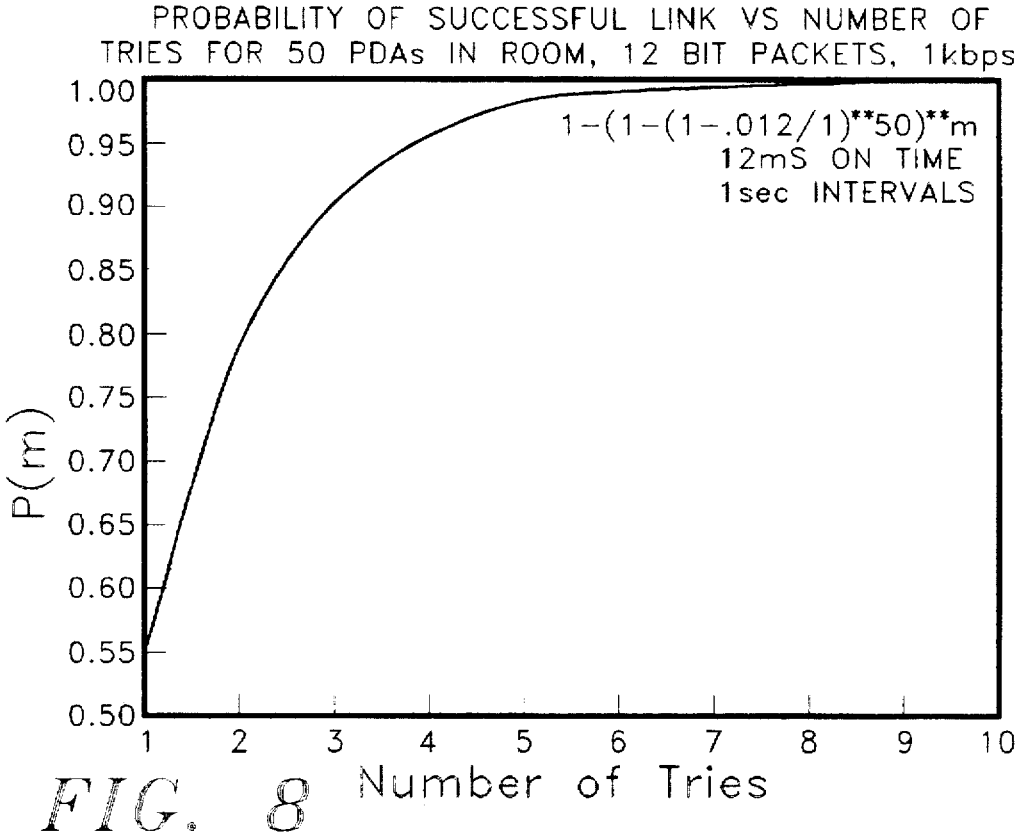
FIG. 8 illustrates a graph representing probabilities that a particular one of 50 of the tags of FIG. 2 will successfully communicate alarm signals with the master transceiver of FIG. 3 per each of a number of transmissions, wherein each tag randomly transmits information signals based upon 1 second intervals.

FIG. 8 illustrates a graph representing probabilities that a particular one tag (e.g., tag 5a1) of 50 transmitting tags 5a1–5xx will successfully communicate 12 bit packet, 1 kbps alarm signals with the master transceiver 3 per each of 10 successive transmissions, wherein each tag 5a1–5xx randomly transmits alarm signals based upon a second average time interval of 1 second duration.

Figure 9:
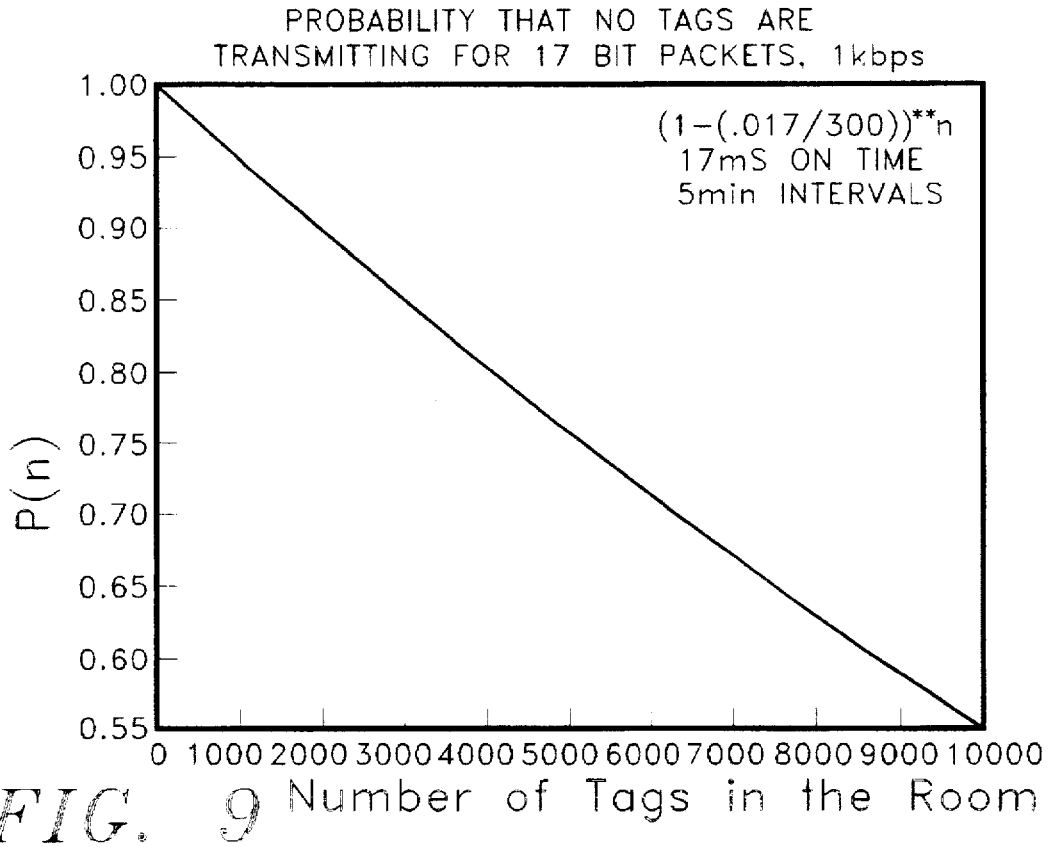
FIG. 9 illustrates a graph representing probabilities that none of a plurality of the tags of FIG. 2 are transmitting information signals at any one time during a confidence mode of operation, for various numbers of tags that are randomly transmitting information signals of 17 millisecond pulse duration, based upon 5 minute intervals.

FIG. 9 illustrates a graph representing probabilities that no tags 5a1–5xx are transmitting information signals at any one time while the tags 5a1–5xx are operating in the confidence mode, wherein there are various numbers (0 to 10000) of tags 5a1–5xx randomly transmitting 17 bit packet, 1 kbps information signals of 17 millisecond pulse duration, based upon a first average time interval of 5 minute duration.

Figure 10:
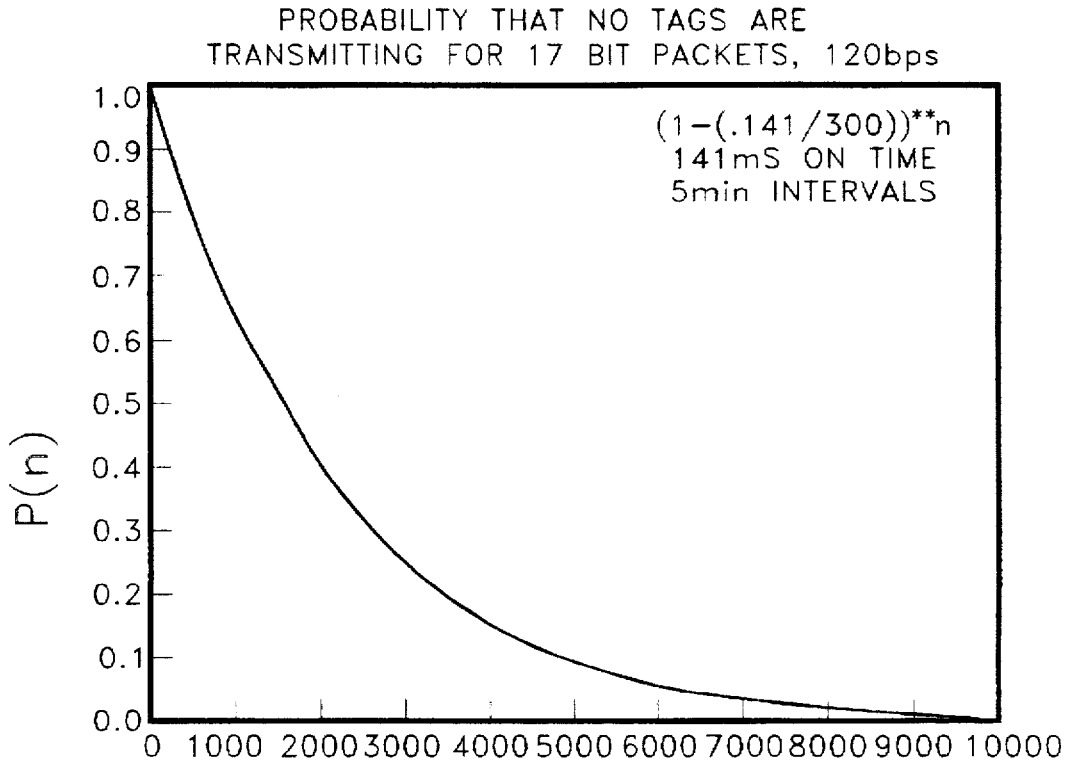
FIG. 10 illustrates a graph representing probabilities that none of a plurality of the tags of FIG. 2 are transmitting information signals at any one time, during a confidence mode of operation, for various numbers of tags that are randomly transmitting information signals of 141 millisecond pulse duration, based upon 5 minute intervals.

FIG. 10 illustrates a graph representing probabilities that no tags 5a1–5xx are transmitting information signals at any one time, during the confidence mode of operation, for various numbers (0 to 10000) of tags 5a1–5xx that are randomly transmitting 17 bit packet, 120 bps information signals of 141 millisecond pulse duration, based upon a first average time interval of 5 minutes.

Figure 11:
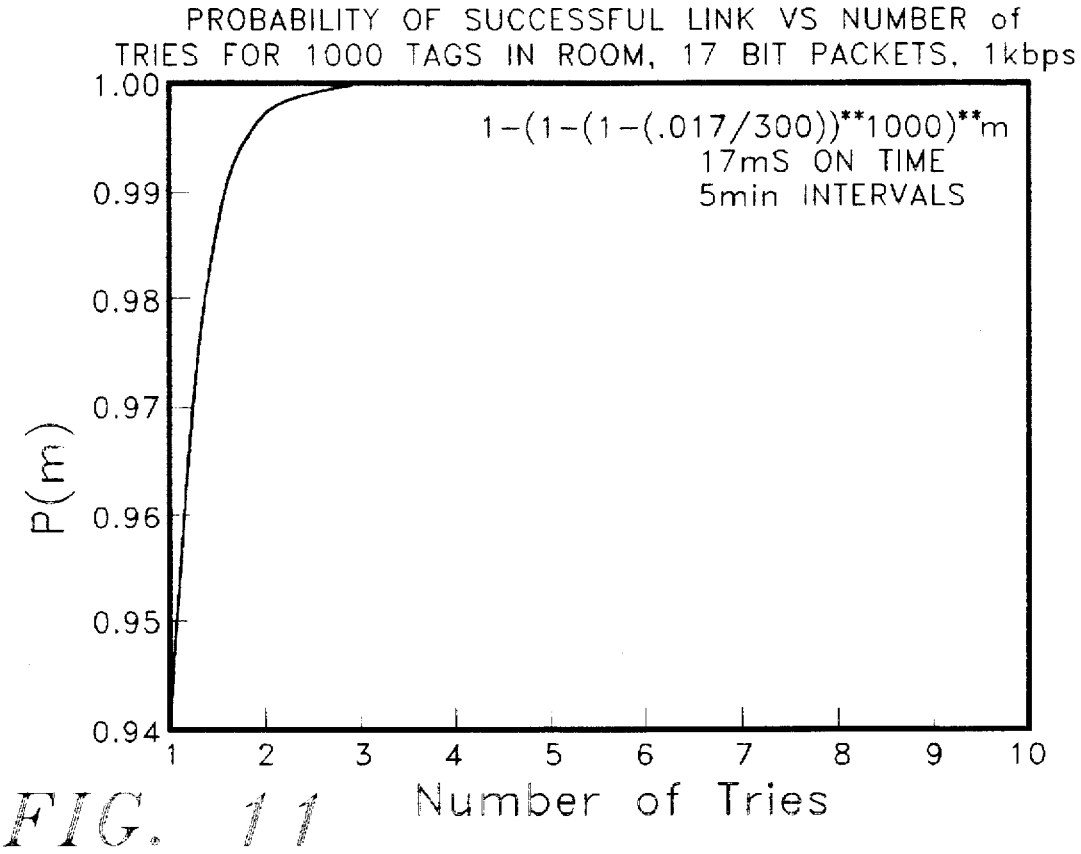
FIG. 11 illustrates a graph representing probabilities that a particular one of 1,000 of the tags of FIG. 2 will successfully communicate 17 millisecond pulse duration information signals with the master transceiver of FIG. 3 per each of a number of random transmissions occurring based upon 5 minute intervals.

FIG. 11 illustrates a graph representing probabilities that a particular one tag (e.g., tag 5a1) of 1000 tags 5a1–5xx will successfully communicate 17 bit packet, 1 kbps, and 17 millisecond pulse duration information signals with the master transceiver 3 per each of 10 successive random transmissions occurring based upon a first average time interval of 5 minutes.

Figure 12:
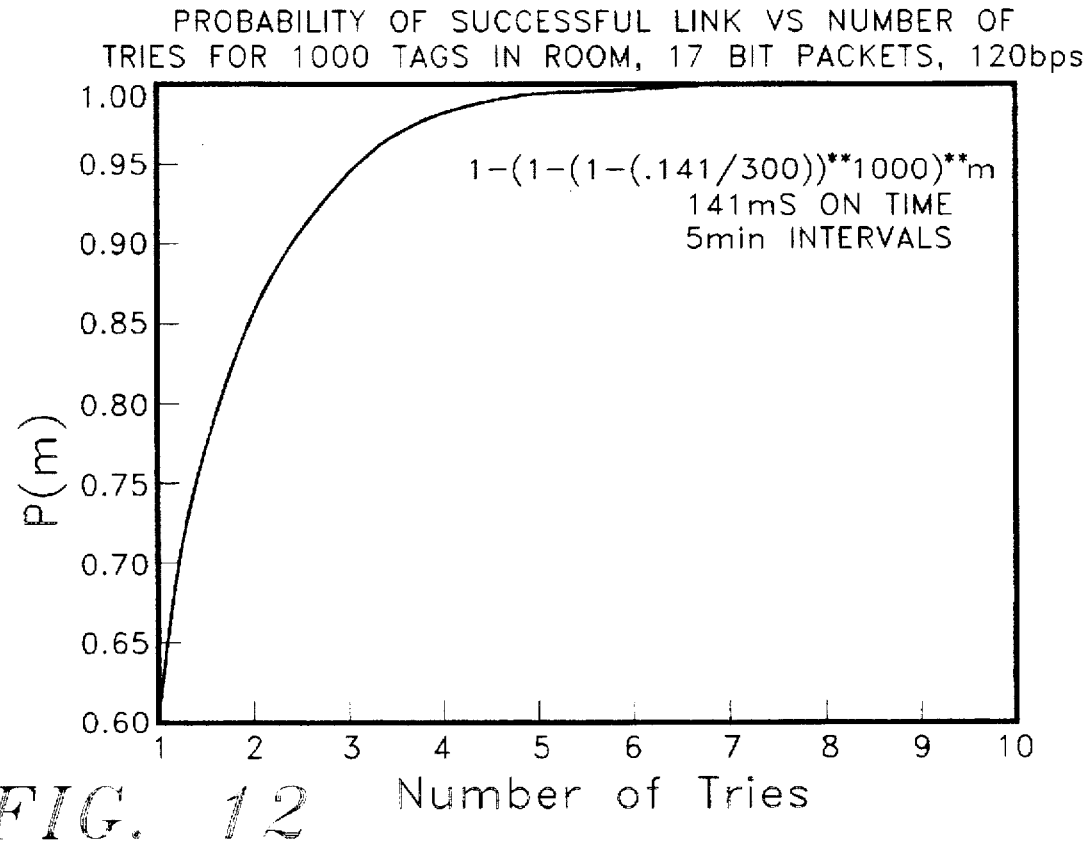
FIG. 12 illustrates a graph representing probabilities that a particular one of 1,000 of the tags of FIG. 2 will successfully communicate 141 millisecond pulse duration information signals with the master transceiver of FIG. 3 per each of a number of random transmissions occurring based upon 5 minute intervals.

FIG. 12 illustrates a graph representing probabilities that a particular one tag (e.g., tag 5a1) of 1000 tags 5a1–5xx will successfully communicate 141 millisecond pulse duration information signals with the master transceiver 3 per each of 10 successive random transmissions occurring based upon a first average time interval of 5 minutes.

Having described embodiments of the invention for transmit-only tags, a further embodiment of the invention will now be described which employs receive/transmit (RX/TX) tags. For the purposes of this description, this further embodiment is referred to as a "Transmit-Then-Receive" (TTR) protocol embodiment wherein individual tags 5a1–5xx transmit signals at intervals to one of the master transceiver 3 or a remote interrogator (e.g., remote interrogator 4a) in order to perform monitoring of persons wearing the tags, in the same manner as was described above. However, for the TTR protocol embodiment each transmission is followed by a predetermined waiting period, during which the tag operates in a receive mode, instead of a transmit mode, for a predetermined time interval. Also, as described above, each of the master transceiver 3 and the remote transceivers 4a–4n comprise (in lieu of the DSSS TX block 44) the OOK TX block 46 which functions as described below.

Figure 4B:
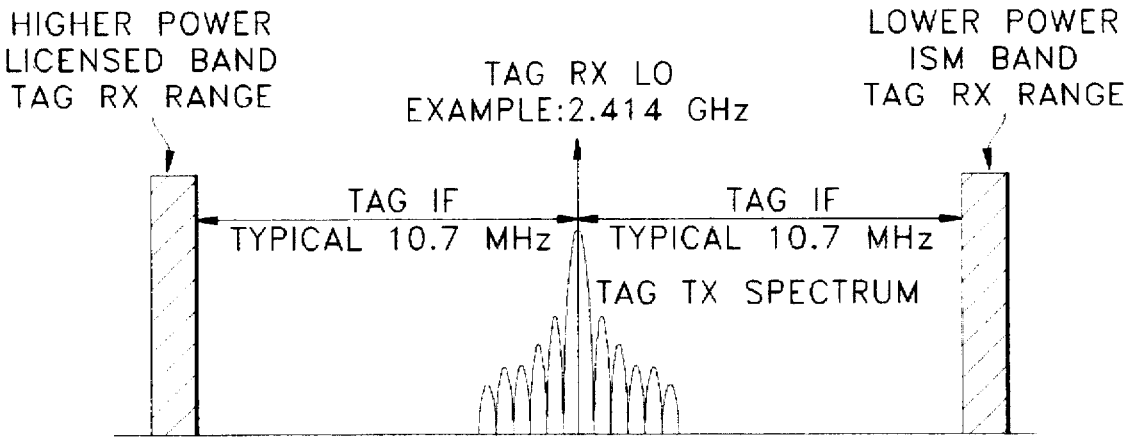
FIG. 4*b* is an illustration of a dual receive band tag scheme in accordance with the invention.
Figure 4C:
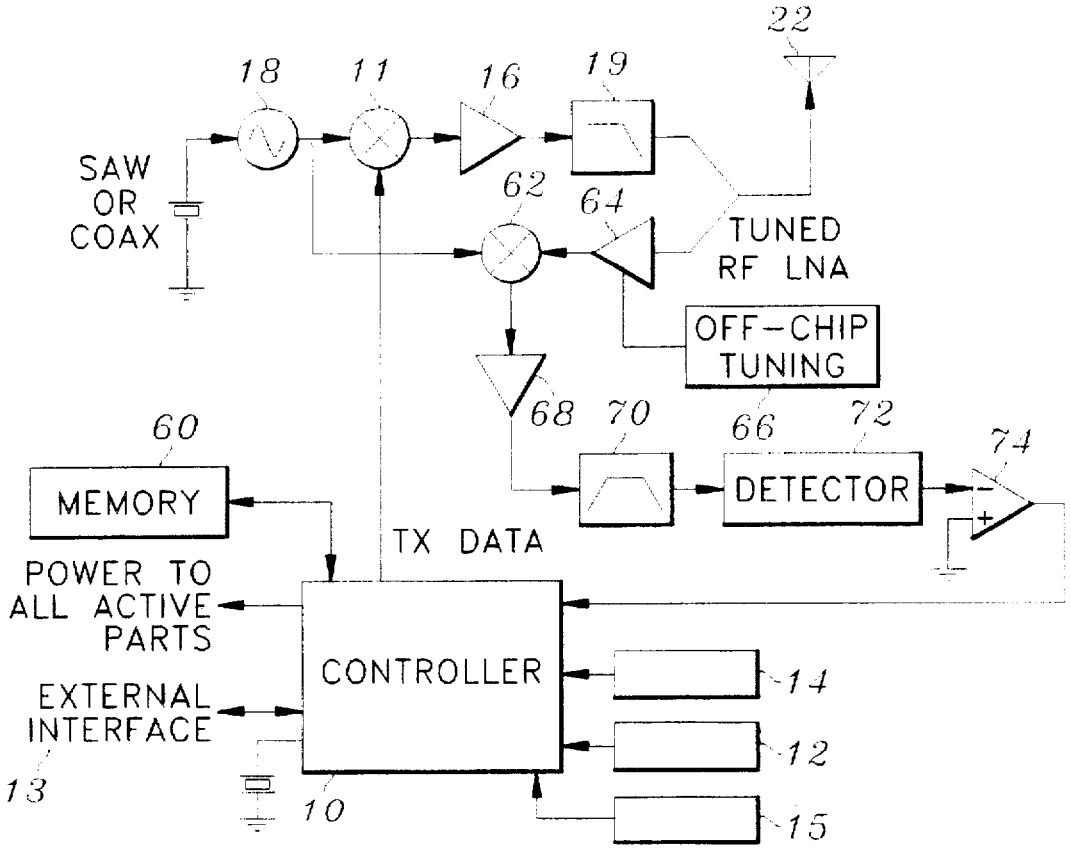
FIG. 4*c* is an illustration of a transmit/receive tag constructed in accordance with a further embodiment of the random interval monitor system of FIG. 1.

FIG. 4c illustrates an RX/TX tag constructed in accordance with a preferred embodiment of this invention. The RX/TX tag is similar to the transmit-only tag of the first embodiment of the invention in that it comprises a local oscillator 18, a modulator 11, an amplifier 16, a filter 19, a microprocessor controller 10, a pressure switch monitor sensor 14, a motion monitor sensor 12, a ground connection sensor 15, an antenna 22, and an external user-interface 13. These elements function in a similar manner to the same elements of the transmit-only tag, although the controller 10 performs additional functions over that for the transmit-only tags. In addition to those elements, the RX/TX tag also comprises a larger memory (e.g., 1 to 100 kilobyte) 60 than the transmit-only tag (whose memory is not illustrated in FIG. 2) and circuitry, namely an OOK receiver circuit, enabling it to receive signals. By example, after a signal is transmitted from the RX/TX tag, the controller 10 controls the RX/TX tag to change its operating mode from the transmit mode to the receive mode for a time interval that is predetermined by, for example, information entered previously into controller 10 via the user-interface 13. The time interval is preferably a short time interval. First, an amplifier 64 has an input that is coupled to antenna 22 such that when the RX/TX tag is in a receive mode and a signal is received by the antenna 22, the signal is amplified to an appropriate level by amplifier 64. The amplifier 64 is tunable by an off-chip tuning block 66. A mixer 62 thereafter mixes the amplified signal with an output of local oscillator 18, whereafter the signal is amplified by amplifier 68 and thence filtered by a filter 70. A detector circuit 72 detects an output of the filter 70 and thereafter provides a signal to a logic block 74 which is, by example, a comparator. The comparator 74 determines whether a signal received from the detector 72 is of a sufficient magnitude (e.g., above a noise level) to indicate a signal is present.

In an exemplary application, after an individual one of the RX/TX tags (e.g., RX/TX tag 5a1) transmits a signal identifying the tag 5a1 at a first random time to, by example, one of the remote transceivers (e.g., remote transceiver 4a), the controller 10 controls the RX/TX tag to change its operating mode from the transmit mode to the receive mode. Thereafter, the remote transceiver 4a receives the signal over antenna 48, which then provides the received signal to DSSS RX block 42, wherein appropriate receiving functions are performed to the signal (FIG. 3). After the signal passes through the DSSS RX block 42, the signal is provided to the processor 40. The processor 40 measures the frequency of the signal, which frequency was set originally at the transmitting RX/TX tag 5a1. This frequency measurement process occurs as a first step in the spread spectrum signal receive operation, and as such does not increase the complexity of the system. Following the frequency determination, the processor 40 controls the OOK TX block 46 to "cycle-on" so as to transmit a return data signal to the RX/TX tag 5a1 at a frequency set to be substantially the same as the measured frequency. The return data signal may carry information specifying, by example, a new first and/or second average time interval for the Rx/TX tag 5a1, an identification number, or that the controller 10 of the RX/TX tag 5a1 shall cease the RX/TX tag 5a1 from making further transmissions. After the signal transmission by the remote transceiver 4a, the processor 40 controls the OOK TX block 46 to turn off. This frequency adjustment scheme allows for improved system characteristics such as, by example, a relatively simple, inexpensive tag Local Oscillator (LO), the minimization of tag IF bandwidth requirements (thereby maximizing sensitivity and operational range), and an inexpensive OOK style receiver.

Following a reception by the RX/TX tag 5a1 of the return signal transmitted from the remote transceiver 4a, the signal traverses the receiving circuitry in the manner described above, ultimately being provided to controller 10. Thereafter, the controller 10 changes the operating mode from the receive mode to the transmit mode, and performs an error check to determine whether the received signal carries error-free data. If it is determined that the return signal does carry error-free data, the tag may indicate same by transmitting an acknowledgement signal back to the remote interrogator 4a. If the controller 10 determines that erroneous data is received, the RX/TX tag 5a1 may transmit a signal to the remote transceiver 4a requesting a re-transmission, whereafter the remote transceiver 4a re-transmits the signal until the TX/RX tag 5a1 controller 10 determines that the signal has been received without error. If the RX/TX controller 10 continually finds an error in the signals received from remote interrogator 4a, and the Rx/Tx tag 5a1 transmits a re-transmission request signal to the remote transceiver 4a a predetermined number of times, the remote transceiver 4a transmits a signal back to the master transceiver 3 indicating failure.

It should be noted that this application is intended to be exemplary and not limiting in scope to the invention. For instance, the master transceiver 3 can function in the same manner as described above for the remote interrogator 4a. Moreover, although the application is described in the context in which the remote interrogator 4a sends a response signal to the RX/TX tag 5a1, in some applications it may not be necessary to send a response signal. By example, data that is received without error need not be acknowledged back to the remote transceiver 4a. It is desirable to have the RX/TX tags 5a1–txx operate at a fixed frequency. For example, FIG. 4b illustrates a preferable approximate frequency (ie., 2.414 GHz) of an Rx tag local oscillator. FIG. 4b also shows possible receive band schemes for the RX/TX tag embodiment of the invention, including an ISM band for low power receive applications, and a higher-frequency licensed band for higher power applications. In accordance with an aspect of this invention, because the tags transmit for short intervals, pause, and then change to a receive mode for a short interval, the tags operate in an energy-efficient manner.

While the invention has been particularly shown and described with respect to preferred embodiments thereof, it will be understood by those skilled in the art that changes in form and details may be made therein without departing from the scope and spirit of the invention.

What is claimed is:

1. A method for monitoring individual persons of a plurality of persons, comprising the steps of:

transmitting information signals at random times from individual ones of a plurality of tags to at least one master transceiver, the individual ones of the plurality of tags each to be worn by a respective person, the information signals transmitted from the individual tags corresponding to whether the tag is in use, and wherein a probability that an individual one of the plurality of tags will transmit an information signal during a period of time that none of the other ones of the plurality of tags are transmitting information signals is represented by $P_{tx}$, where:

$$P_{tx} = \left[ 1 - \frac{ton}{ton + toff} \right]^n$$

or $$P_{tx} = 1 - \left[ 1 - \left[ 1 - \frac{ton}{ton + toff} \right]^n \right]^m$$

and where ton represents a duration of an information signal transmission; toff represents an average time interval between chronological information signal transmissions of interest; n represents the number of the other ones of the plurality of tags, and m represents a number of transmissions attempted during the time period;

in response to the at least one master transceiver receiving an information signal to an associated confirmation device; and within the confirmation device, in response to receiving an information signal from the master transceiver, confirming that the person corresponding to the tag generating the information signal is accounted for.

2. A method as set forth in claim 1, wherein the random times occur as a function of a first specified time interval.

3. A method as set forth in claim 2, wherein the random times also occur as a function of a rate at which specified events are detected by at least one sensor.

4. A method as set forth in claim 1, wherein the step of transmitting is performed to transmit the information signals from individual tags to at least one of the at least one master transceiver and at least one remote transceiver.

5. A method as set forth in claim 4, wherein for a case in which the information signals are transmitted to the at least one remote transceiver, the remote transceiver receives information signals from at least one of the plurality of tags and, in response to receiving each of the information signals, relays the signal to the master transceiver.

6. A method as set forth in claim 4, wherein the remote transceiver receives information signals from the at least one of the plurality of tags depending upon, at least in part, a position of the remote transceiver relative to that of the at least one of the plurality of tags.

7. A method as set forth in claim 4, wherein whether the individual ones of the plurality of tags transmit information signals to the master transceiver or to the remote transceiver depends upon, at least in part, positions of the individual ones of the plurality of tags relative to positions of the master transceiver and the remote transceiver.

8. A method as set forth in claim 1, wherein individual ones of the random times occur randomly during respective individual ones of sequentially occurring time intervals.

9. A method as set forth in claim 1, further comprising the step of:

detecting an occurrence or non-occurrence of a specified event affecting any of the persons wearing the tags, wherein in response thereto, the tag to be worn by an affected person transmits information signals based upon random times occurring as a function of a second specified time interval.

10. A method as set forth in claim 9, wherein at least a first one and a second one of the information signals are transmitted such that they are temporarily separated as a function of the second specified time interval, thereby indicating the detection of the specified event occurring to the affected person, and wherein the step of confirming further comprises the step of:

determining that the first one and the second one of the information signals have been received and are temporarily separated as a function of the second specified time interval, and recognizing thereafter the detection of the specified event occurring to the affected person.

11. A method as set forth in claim 10, wherein the specified event or lack thereof is at least one of pressure contact with the tag, motion, ground connection, and circuit completion.

12. A method as set forth in claim 10, wherein individual ones of the random times occur randomly during respective individual ones of sequentially occurring time intervals.

13. A method as set forth in claim 4, further comprising the step of:

within at least one of the master transceivers, the at least one remote transceiver, and the confirmation device, in response to receiving an information signal originally transmitted from an individual one of the originally transmitted from an individual one of the tags, measuring a signal strength of the received information signal to obtain a measured signal strength of the received information signal; and based upon a difference between the measured signal strength of the received information signal and a reference signal strength, determining at least one of a displacement and a location of a person wearing the tag.

14. A method as set forth in claim 1, wherein the step of transmitting is performed using a Direct Sequence Spread Spectrum (DSSS) technique.

15. A method as set forth in claim 5, wherein the step of transmitting is performed using a Direct Sequence Spread Spectrum (DSSS) technique.

16. A method as set forth in claim 1, wherein each individual one of the plurality of tags transmits information signals independently from other ones of the plurality of tags, thereby limiting a probability that the master transceiver will receive more than one information signal simultaneously.

17. A method as set forth in claim 1, further comprising the steps of:

at individual ones of the plurality of tags:

in response to transmitting a first one of the information signals, switching to a receive mode of operation for a predetermined time interval; and in response to an expiration of the predetermined time interval, switching to a transmit mode of operation by which a second one of the information signals is transmitted.

18. A method as set forth in claim 17 wherein in response to the at least one master receiver receiving a first information signal from any one of the plurality of tags, the master receiver performs the steps of:

determining a frequency of the received first information signal; and transmitting a response signal to the tag from which the first information signal was received such that the tag receives the response signal during the predetermined time interval.

19. A method as set forth in claim 18, wherein the response to receiving the response signal, the tag error checks the response signal, whereafter the tag transmits a signal to the master receiver indicating whether or not an error has been detected in the response signal.

20. A monitoring system having a self monitor to verify usage, the system comprising:

a housing wearable by a person;

a transmitter disposed within the housing;

a pressure sensor in electrical communication with the transmitter and disposed within the housing to extend therefrom and be in contact with the person when the housing is worn to thereby impose pressure on the sensor and create an electrical signal, said pressure sensor communicating to the transmitter a first electrical signal comprising the presence or absence of said pressure;

a motion sensor in electrical communication with the transmitter and disposed within the housing to detect motion thereof, said motion sensor detect motion thereof, said motion sensor communicating to the transmitter a second electrical signal comprising the presence or absence of said motion;

a ground connection sensor in electrical communication with the transmitter and disposed within the housing, said ground connection sensor having a ground connector leading therefrom and attachable to a ground site, said ground site having a ground connection confirmation signal transferable through the ground connector to the ground connection sensor to detect ground connection of the device and communicate to the transmitter a third electrical signal comprising the presence or absence of said ground connection; and at least one receiver capable of receiving transmissions of pressure, motion, and ground connection information transmitted by the transmitter.

21. A monitoring system as claimed in claim 20 wherein the housing wearable by a person is adapted to be worn on a wrist.

22. A monitoring system as claimed in claim 21 wherein the housing is attachable to the person with a wrist strap.

23. A monitoring system as claimed in claim 20 wherein a plurality of receivers are respectively situated at a plurality of sites.

24. A monitoring system as claimed in claim 20 wherein the ground connector comprises two wires disposed between the ground site and the ground connection sensor.

25. A monitoring system as claimed in claim 24 wherein the ground connector has therein a resistor and the ground connection confirmation signal is resistance by the resistor of an electrical signal transferred from the ground site through the ground connector.

26. A monitoring system as claimed in claim 20 wherein the motion sensor comprises a switch normally in a closed circuit configuration and open for brief intervals during movement.

27. A personal monitor having a self monitor to verify usage, the monitor comprising:

a housing wearable by a person;

a transmitter disposed within the housing;

a pressure sensor in electrical communication with the transmitter and disposed within the housing to extend therefrom and be in contact with the person when the housing is worn to thereby impose pressure on the sensor and create an electrical signal, said pressure sensor communicating to the transmitter a first electrical signal comprising the presence or absence of said pressure;

a motion sensor in electrical communication with the transmitter and disposed within the housing to detect motion thereof, said motion sensor communicating to the transmitter a second electrical signal comprising the presence or absence of said motion; and a ground connection sensor in electrical communication with the transmitter and disposed within the housing, said ground connection sensor having a ground connector leading therefrom and attachable to a ground site, said ground site having a ground connection confirmation signal transferable through the ground connector to the ground connection sensor to detect ground connection of the device and communicate to the transmitter a third electrical signal comprising the presence or absence of said ground connection.

* * * * *